US005460312A

United States Patent [19]

Bräu et al.

[11] Patent Number: 5,460,312

[45] Date of Patent: Oct. 24, 1995

[54] METHOD OF AND APPARATUS FOR CONTROLLING LATERAL DEVIATIONS OF A TRAVELLING FABRIC WEB

[75] Inventors: Jürgen Bräu; Jürgen Eisen, both of Augsburg; Hans Seibold, Stadtbergen; Martin Zeh, Augsburg; Günter Franz, Meitlingen, all of Germany.

[73] Assignee: Erhart + Leimer GmbH, Augsburg, Germany

[21] Appl. No.: 143,838

[22] Filed: Oct. 27, 1993

[30] Foreign Application Priority Data

Oct. 28, 1992 [DE] Germany ..... 42 36 302.0

[51] Int. Cl.[6] ..... B65H 23/032; G05D 3/20

[52] U.S. Cl. ..... 226/15; 226/3

[58] Field of Search ..... 226/15, 18, 19, 226/20, 3; 250/561, 563, 571, 221, 222.1

[56] References Cited

U.S. PATENT DOCUMENTS

| | | | |
|---|---|---|---|
| 4,075,604 | 2/1978 | Degasperi | 340/146.3 AG |
| 4,135,664 | 1/1979 | Resh | 235/475 |
| 4,600,837 | 8/1986 | DiStefano et al. | 250/235 |
| 4,782,238 | 11/1988 | Radl et al. | 250/561 |
| 4,922,337 | 5/1990 | Hunt et al. | 348/88 |
| 5,058,793 | 10/1991 | Neville et al. | 226/15 |

FOREIGN PATENT DOCUMENTS

4131365A1 4/1993 Germany .

*Primary Examiner*—Daniel P. Stodola
*Assistant Examiner*—Thomas E. Dunn
*Attorney, Agent, or Firm*—Herbert Dubno

[57] ABSTRACT

The travel of a fabric web is corrected by an image acquisition from a region thereof including a guidance criterium which can be interrupted to produce a single row of image points, the signals of which are digitalized and compared with a reference signal by relative shifting of the stored signals in two shift registers. The number of shifts required to bring about correlation is determined as a measure of the actual position of the web and compared to a setpoint position for operation of an effector restoring the web to its set point position.

13 Claims, 3 Drawing Sheets

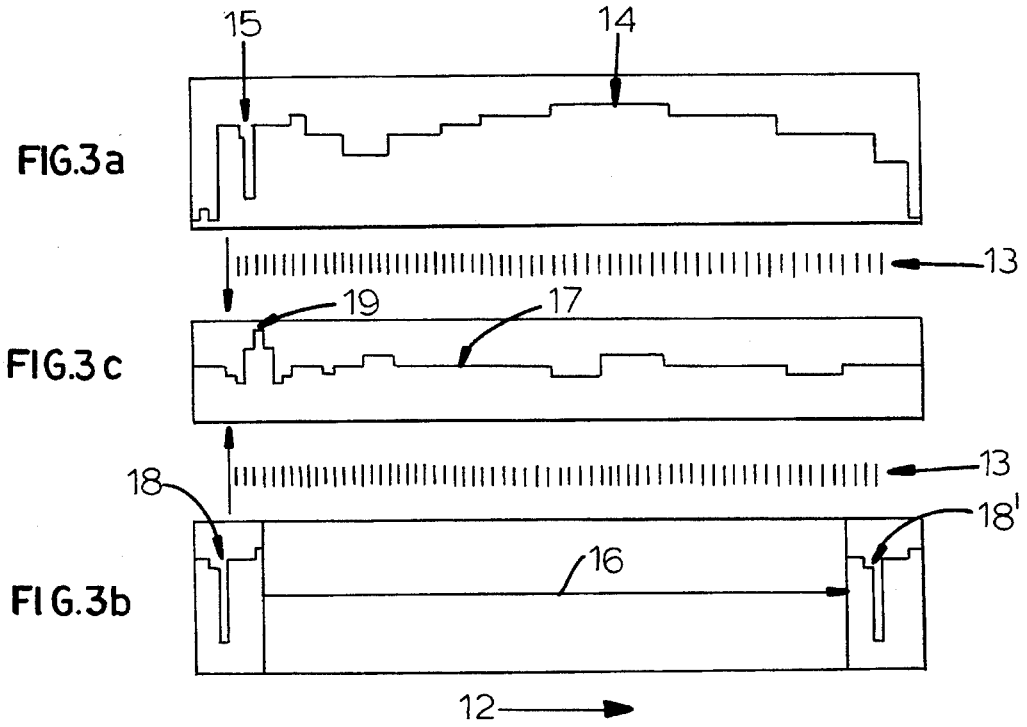
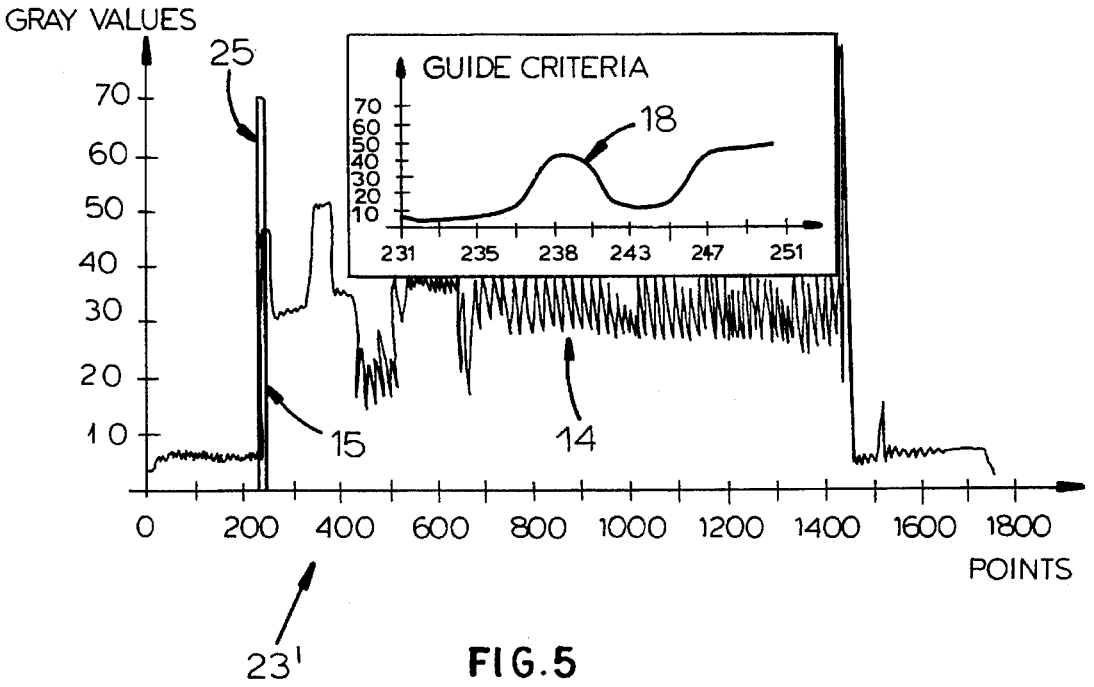
FIG.5

METHOD OF AND APPARATUS FOR CONTROLLING LATERAL DEVIATIONS OF A TRAVELLING FABRIC WEB

FIELD OF THE INVENTION

Our present invention relates to a method of and to an apparatus for controlling lateral deviations of a travelling web, and more particularly, to a system for reestablishing a setpoint position of a travelling web, following a deviation thereof to one side or another of its setpoint path, based upon detecting the position of a guide criterium of the web and resetting the position of the web by an appropriate effector to compensate for such deviation.

BACKGROUND OF THE INVENTION

In German Patent document DE 41 31 365 and corresponding to commonly assigned application Ser. No. 07/948,157, filed 21 Sep. 1992, now abandoned, a process for travelling lateral deviation of a travelling web from a setpoint position or desired position is described which involves determining the actual position (instantaneous position). The actual or instantaneous position is then compared with the setpoint position and a setting signal is formed for the operation of the effector which influences the fabric web position in dependence upon the deviation of the actual position from the desired or setpoint position.

In that system, an image/signal converter, especially a video camera, is used to take a picture or acquire an image of at least one longitudinal strip through which a guide criterium of the web runs in the longitudinal or travelling direction of the web.

The travelling web, of course, moves past the image/signal converter and thus the image of the successive strips of the web is repetitively captured or acquired cyclically. For each image acquisition the image can be stored and from it, by signal evaluation or processing, the actual position of the guide criterium is determined and used as an actual value signal for controlling the position of the web in the position correction process.

The process described in the above described application and German patent document, utilizes a guide criterium which can be an edge formed by a jump in the web thickness.

It is also known to use for guiding a travelling web, a boundary edge itself or a continuous line which can be, for example, printed on the fabric web.

All of these conventional processes utilizing continuous guide criteria have in common that the signal image acquired by the image/signal converter can only use flank spacers and flank orientations to determine the actual position. That, of course, means that the guide criterium must generate in the signal image clear and sharply delineated flanks. Because of this requirement, there are only a few structures or patterns in or on the web which are suitable to serve as guide criteria.

OBJECTS OF THE INVENTION

It is the principal object of the present invention, therefore, to provide an improved method of and apparatus for controlling the position of a travelling fabric web so that the aforedescribed limitations on the guide criteria can be eliminated or reduced.

More specifically it is an object of the invention to provide a control method or system which allows features of the travelling printed or unprinted fabric web which extend in the longitudinal direction and have not been useable heretofore as guide criteria, to be employed for reliable web guidance.

It is, therefore, also an object of the invention to allow such features to be employed as guide criteria as can be interruptions in the longitudinal direction like so-called print alleys, interrupted lines in the printed pattern or in the structure on fabrication of the web or at the edge, adhesive appliques, water marks and the like.

It is still another object of the invention to provide an improved apparatus for controlling lateral deviations of a travelling fabric web and especially to restore a travelling fabric web to a setpoint or desired orientation which is more reliable than earlier apparatus for that purpose.

SUMMARY OF THE INVENTION

These objects and others which will become apparent hereinafter are attained, in accordance with the invention by deriving from each acquisition (image acquisition) of the total image content of an image field of the fabric web captured by the image/signal converter, only a single row of image points extending over the entire width of that image field. The single row of image points is converted to corresponding signals and the corresponding image signals are digitalized image point by image point across the width of the web, i.e. transverse to the web travelling direction.

Before the beginning of the control process the image signals representing the guide criterium are stored image point by image point as fixed reference signals or a fixed reference signal.

During the control process the image point rows with the stored image signals are shifted cyclically image point by image point relative to the image point row of the stored reference signals and at each shifting step, a similarity function is calculated between the reference and acquired signal sequences to yield a value which is a measure of the degree of coincidence or agreement of the two image and reference signal sequences. For each image acquisition from the number of shifting cycles to determine the best agreement in accordance with the similarity function, the respective actual position of the guide criterium is determined. The degree of shift to reach the best agreement position thus represents the error in the offset of the web and the degree of correction to the setpoint value which is required.

Because of the transformation of the total image content of the image field picked up by the image/signal converter of the fabric web into image signals of only a single row of image points, whether by optical or electrical processes, the image signal of each of these image points contains an average or mean along an imaginary column corresponding to the respective image point and extending to the web travel direction, i.e. the longitudinal direction of the web over the imaged region of the fabric web. Reference here to an "average" may also, of course, include an integration with distance along the web or a summing over the length of that image field which is acquired in the image acquisition process.

As a result any interruptions of the guide criteria along any column can be averaged out and will not materially affect the signal pattern along the row in the width of the web and transverse to the direction of travel.

In the transverse direction, therefore, in spite of possible interruptions in the longitudinal direction, the guide criterium will yield a pattern that can readily match the stored reference pattern and enables, upon the cyclical comparison of the actual value integrated or averaged rows in succession with the stored reference, recognition of the guide criterium by the similarity function so that the coincidence can give the actual value of the position to the guide criterium for control.

This pattern comparison can be effected independently of the particular guide criterium or the features of the web which constitute it. It suffices that the pattern of the guide criterium is recognizable from the signal pattern of each image acquisition.

Preferably the image acquisition field of the image/signal converter extends over the entire width of the fabric web so that the features of the web which can serve as the guide criterium can lie optionally at any location across the web.

The conversion of the image contact of the acquisition field into image signals of only a single row of image points can, as has already been stated, be effected in an optical or electrical manner. In the first case, preferably the image/signal converter is a line camera with only a single row of image sensors extending transversely to the web travel direction and the acquisition field of the image/signal converter is rendered monodimensional in an optical manner by the imaging of this row of image sensors. Here the imaging optics can provide the averaging. For example, a cylindrical lens can form the image optics and can pick up the density along a respective column corresponding to each point all at once during the image acquisition.

In the case in which the averaging is effected in an electrical manner, the image/signal converter is used with a two-dimensional acquisition field but with each image column in the web travel direction generating only a single image point and a respective image signal by electronically averaging over the image signals all of image values of a given column for the respective single image point signal.

The process according to the invention also affords the highly advantageous possibility of selecting the guide criterium for a particular fabric web initially from the signal image of an image acquisition from the fabric web itself because, for example, a pattern can be initially detected in such a signal image which has an especially outstanding or pregnant formation or contour and thus is particularly valuable as a reference pattern for the subsequent image comparison.

For this purpose a preferred feature of the invention is that at the beginning of the control process the image points or image point optical densities are obtained from all of the image points of the respective columns over the entire width of the web as a single image point row and graphically plotted on a coordinate axis corresponding to that row. The graphic plot will readily show up in a particularly pregnant contour in the signal pattern which can be chosen as the guide criterium and the image signals which are then stored for a subsequent image comparison.

Any conventional pattern comparison technique common in mathematical processes can be used to effect image comparison and to constitute the similarity function as long as it can distinguish with, in the shifting of the actual averaged image signal pattern, a similarity or coincidence which is established with the reference signal pattern. Suitable mathematical techniques can involve difference formation, correlation techniques and especially cross-correlation techniques.

For carrying out the process according to the invention, an apparatus can advantageously be used which comprises a correlator of a known configuration with two shift registers for storing the image signal of each image acquisition and the reference signal. It can also include a clock generator for signal shifting in the shift registers, a series of multipliers for producing the products of the image signals and reference signal and, an adder or summer for summing the products and having as many inputs as there are multipliers.

Furthermore, connected to the summer is a computer which determines the maximum value of the output signal of the summer and from this maximum value the associated clock count of the signal shifting representing the actual value of the position of the guide criterium. For an especially simple selection of the guide criterium, an embodiment of the apparatus of the invention has an image monitor, e.g. a cathode ray tube display, for graphic display of the image signals of all image points and, for selection of the reference signal, a window generator capable of displaying its window on the screen of the monitor so that the image signals lying within the window can be captured and stored as the reference signal.

Input means is provided to allow selection and adjustment of the size and the position of the window along the image point row. It has also been found to be advantageous to provide the image monitor of the touch-screen type, i.e. with a pressure-sensitive screen so that the window position can be set by simply touching the screen. More particularly the process of the invention can comprise:

(a) storing a sequence of reference signals corresponding image point by image point across the web to values representing a reference scan along a line perpendicular to the direction of travel and distinguishing the guidance criterium at a location corresponding to a setpoint location of the guidance criterium of the web during the travel thereof;

(b) with an image/signal converter acquiring an image of the pattern across the web as the web is traveling past the converter, converting the image into a sequence of image signals each representing an average image value along an imaginary column parallel to the direction but arrayed across a width of the web, digitalizing the image values, image point by image point across the width, into a digital signal having the guidance criterium of the image distinguished by a distinct actual value representing an instantaneous location of the guidance criterium during the travel of the web, and storing the digitalized signal;

(c) shifting the digital signal formed in step (b) relative to the stored reference sequence of step (a) image point by image point in a series of shifting cycles and for each shifting cycle, calculating a similarity function whose value is a measure of a degree of correspondence of the reference sequence and the digital signal;

(d) for each image acquisition in step (b) determining the best correspondence of the reference signal and the digital signal from the similarity function, thereby deriving from the shift a correction value by which the actual position of the guidance criterium of the web deviates from the setpoint location thereof;

(e) actuating an effector capable of influencing the lateral position of the web in accordance with the correction value; and (f) repeating steps (b) through (e) with successive acquisitions of images from strips across the web transverse to the direction of travel at a predetermined cadence.

The apparatus for controlling lateral deviations of the travelling web from a setpoint position, wherein the web has a pattern defining a guidance criterium extending into the direction of web travel, can comprise:

means for storing a sequence of reference signals corresponding image point by image point across the web to values representing a reference scan along a line perpendicular to the direction of travel and distinguishing the guidance criterium at a location corresponding to a setpoint location of the guidance criterium of the web during the travel thereof;

an image/signal converter including means for acquiring an image of the pattern across the web as the web is traveling past the converter, converting the image into a sequence of image signals each representing an average image value along an imaginary column parallel to the direction but arrayed across a width of the web, digitalizing the image values, image point by image point across the width, into a digital signal having the guidance criterium of the image distinguished by a distinct actual value representing an instantaneous location of the guidance criterium during the travel of the web, and storing the digitalized signal;

means for shifting the digital signal relative to the stored reference sequence image point by image point in a series of shifting cycles and for each shifting cycle, calculating a similarity function whose value is a measure of a degree of correspondence of the reference sequence and the digital signal;

means, connected with the means for shifting and in each image acquisition, for determining the best correspondence of the reference signal and the digital signal from the similarity function, thereby deriving from the shift a correction value by which the actual position of the guidance criterium of the web deviates from the setpoint location thereof; and an effector connected to the means for determining the best correspondence and capable of influencing the lateral position of the web in accordance with the correction value.

BRIEF DESCRIPTION OF THE DRAWING

The above and other objects, features and advantages of the invention will become more readily apparent from the following description, reference being made to the accompanying highly diagrammatic drawing in which:

FIG. 3*a*–3*c* are diagrams illustrating the image comparison steps in accordance with the practice of the invention;

FIG. 5 is a diagram of a monitor display typical of the invention.

SPECIFIC DESCRIPTION

Figure 1:
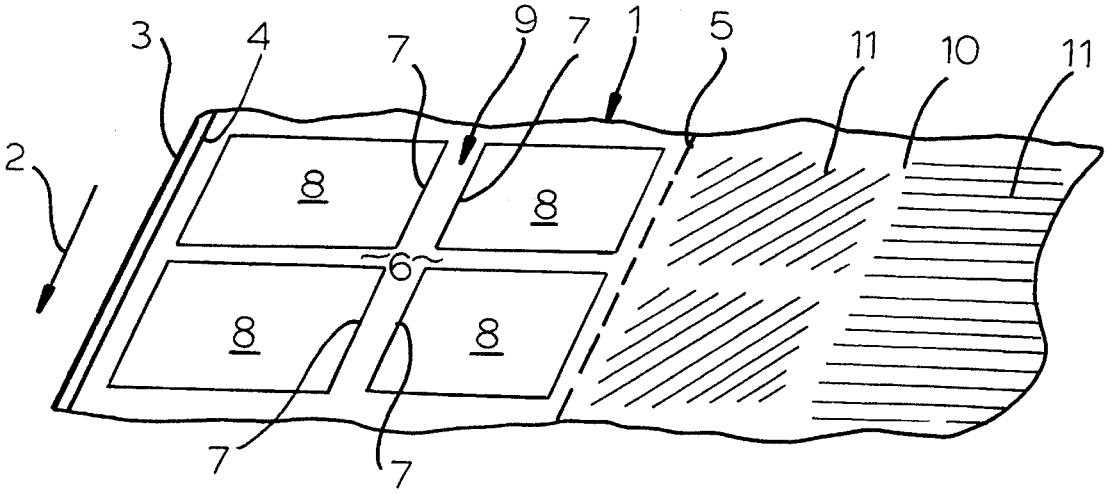
FIG. 1 is a plan view of a section of a printed fabric web illustrating different features suitable for constituting respective guide criteria, one of which can be used as the guide criterium for determining the actual position of the web in accordance with the principles of the present invention.

In FIG. 1 we have shown on the fabric section 1 which has been illustrated, a number of different features which are capable of forming the guide criterium for establishing the actual position of the web.

Such a guide criterium can be formed, for example, by one of the longitudinal edges 3 of the web.

Alternatively, it can be formed by a continuous line 4 formed in or printed on the fabric web. Both the edge 3 and the line 4 are continuous along the length of the web and thus do not require averaging or the solution of the present invention, although the method and apparatus, especially designed for dealing with guide criteria which can be interrupted, are equally applicable to continuous line criteria as represented by the guide criteria 3 and 4.

With the process according to the invention, however, even broken lines running in the travel direction or lines which are interrupted from time to time because of patterning considerations can be used as guide criteria. So, for example, a broken line 5 printed on the fabric or formed by a structure thereof or by a thread woven into the fabric can be used as the guide criterium.

It is also possible to utilize the lines 7 ordering printed fields 8 and interrupted by gaps 6 and flanking print alleys 9 which separate these fields, as the guide criterium or as guide criteria.

Indeed, according to the invention even a print alley as shown at 10 between print fields 11 and without boundary lines can be used as the guide criterium. In this case, the pattern has a region of low image density as compared with regions of high image density where printed lines are detected. The print alley 10 can even have open patterns as shown.

Figure 2:
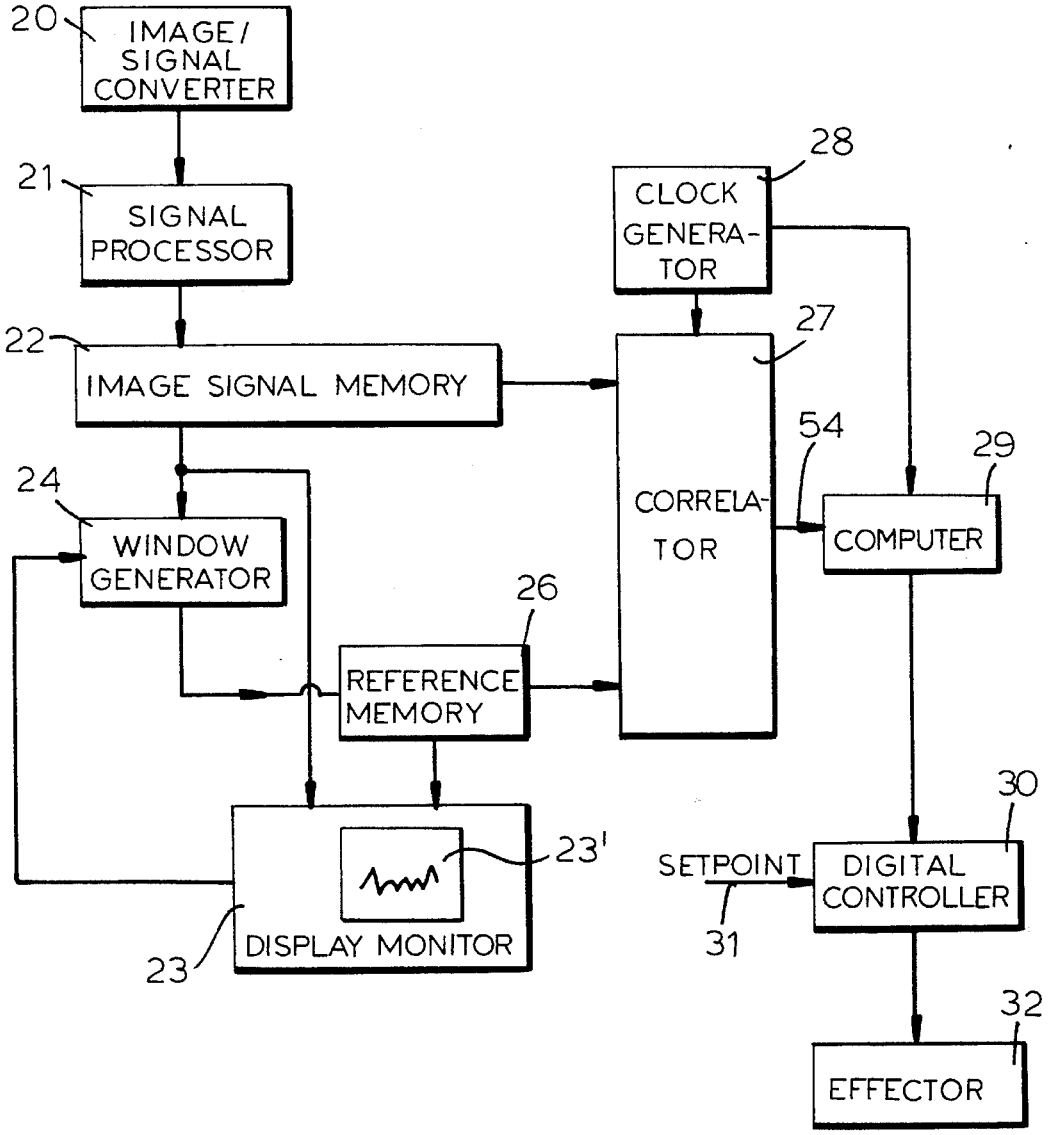
FIG. 2 is a block diagram of a circuit illustrating application of the processes for formation and recognition of a guide criterium.

For establishing the reference and hence the pattern with which the actual pattern is compared, and as shown in FIG. 2, an image/signal converter 20, e.g. a line camera or CCD camera acquiring an image of an entire field of the web can be used. The image/signal converter 20 can thus pick up or acquire as an image the total image content of a field or region (image acquisition) and can convert that image into a single row of image points, each averaging the light/dark intensity values (grey values) for an entire column in the travel direction.

The single row of image points can extend over the width of the web transverse to the web travel direction. Each of these image points thus yields an image signal representing an average of the brightness values of all fabric web points in an imaginary column aligned with the respective image point, the columns being spread in the direction of the width of the web and extending into the longitudinal direction, i.e. the direction of travel 2 of the web as shown in FIG. 1.

In each of these image points, there is thus a value of the brightness over all of the imaginary column. In other words the image/signal converter subdivides the fabric web over its width into as many parallel web columns extending in the travel direction as their image points in the single row extending across the web width. The image signal of each image point contains within the points of the acquired image field, the total image content of the entire associated column.

As a result, the interruptions in lines 5 and 7 on the fabric web 1, although they contribute nothing to the value of the image signal of the particular column, are averaged into the total signal value and do not detract significantly from the peak which is provided at that column as long as the image acquisition region or field in the direction of travel of the fabric web is of greater length than the interruptions.

FIGS. 3*a*–3*c* shows that, in the width direction (arrow 12), a row of image points 13 can be provided. In FIG. 3*a*, we have illustrated a typical image acquisition of a region of the fabric web for each image point 13 of which, the value of the image signal has been plotted along the ordinate. The signals collectively form the signal image referred to previously. Within this signal image there is especially pronounced and as can be seen in FIG. 3*a*, the pattern 15 which can represent the guide criterium.

In FIG. 3*b*, the equivalent pattern 15 has been recorded as the reference pattern 18 and has been stored at the location corresponding to the desired or setpoint position of the guide criterium.

When the reference pattern 18 is then stepped in the direction of the arrow 16, image point by image point relative to the pattern 14 to its final position 18' and for each such shift a similarity function is calculated, whose value represents the degree of coincidence, as shown for the similarity function 17 plotted in FIG. 3*c*, a maximum is reached at 19 and represents the actual position of the guide criterium. The steps between the starting position of reference pattern 18 and the image point corresponding to the maximum value 19 represents the error by which the position of the web must be corrected. As can be seen camera producing only a single row of values for its single row of image sensors, or a video camera which can capture a two-dimensional image of an entire field of the web, and can be provided with electronics for averaging to yield the single row of image signals, is connected to a signal processor 21 capable of digitizing the image point signals.

The signal processor 21 is connected to an image signal store or memory 22. When a two-dimensional video camera is used, the image signal memory can serve to correct point by point values for the single row of points.

Before beginning the control process, the image signal stored in the memory 22 is transferred to the image monitor 23 directly where it is displayed on the screen 23' and thus graphically reproduced. The displayed image can correspond substantially to the image 14 shown in FIG. 3*a*.

With the aid of a window generator 24, a window is produced in the display 23' and can be moved to capture the critical part of the displayed image as the reference signal representing the guide criterium which is to be used as a measure of the shift of the web. The window selection and movement can be effected by simple touching of the screen 23' if it is a pressure-sensitive touch screen.

From FIG. 5 it will be apparent that the window 25 of the screen 23' can select that portion of the screen image 14 in which the pattern 15 falls to select that portion as the guide criterium.

This signal value is stored in the reference memory 26.

The reference pattern 18 can also be graphically displayed upon the screen so that the display scale for the signal image 14 and the reference pattern 18 can be selected to be different if desired.

Figure 4:
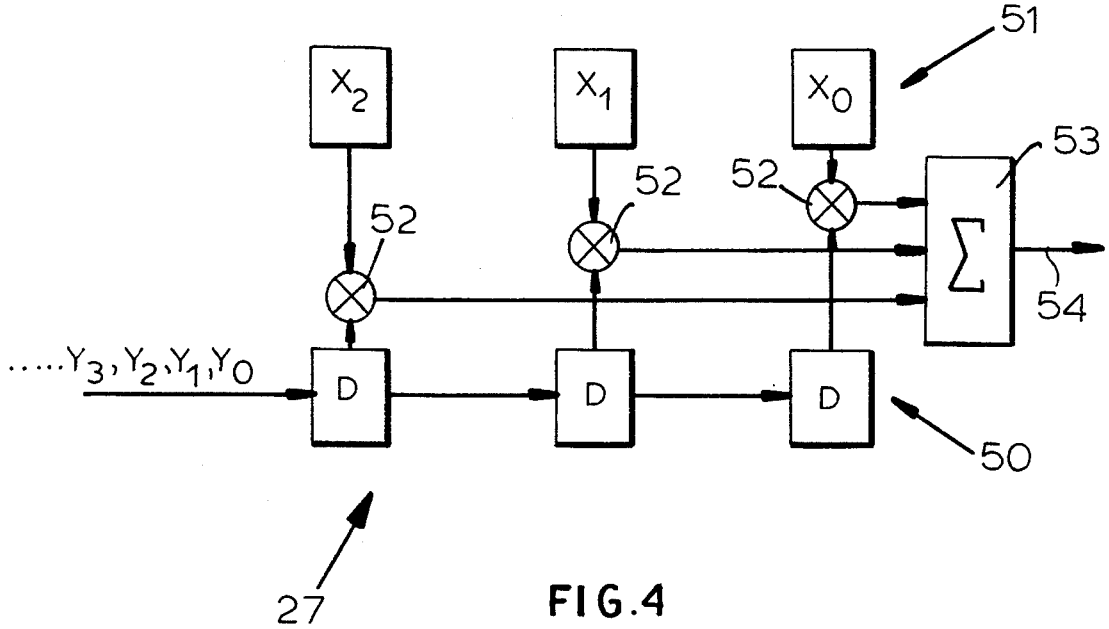
FIG. 4 is a block diagram illustrating a correlator used for image recognition according to the invention.

From the image signal in memory 22 and the reference signal in memory 26, correlation is effected in the correlator 27 utilizing a similarity function 17. A simple example of such a correlator has been illustrated in FIG. 4. This correlator can comprise a shift register 50 with register position D holding the image signals received from the image signal memory 22 and a shift register 51 with positions in which the reference signal is stored.

In this embodiment, multipliers 52 are provided for forming the products of the respective positions of the shift registers and those equal in number to those positions. The multipliers feed a corresponding number of inputs of a summer or adder 53, the output of which at 54 is a summation of the products forming the similarity function. This kind of similarity function is a correlation function and reference may be had to the publication: *Hossein Yassaie, IMS A* 100 *Application Note* 3 *"Correlation and Convolution with the IMS A*100" of the Firm INMOS, Bristol, Great Britain.

The image signals are represented at $Y_o$, $Y_1$, $Y_2 \ldots Y_N$ for each image acquisition and the reference signals are represented at $X_o$, $X_1$, $X_2$.

The output 54 of the correlator 27 is applied to the computer 29 which calculates the maximum 19 of the similarity function. The computer 29 also receives an input from a clock generator 28 having another input applied to the correlator 27. The computer also calculates the number of shifting cycles required to attain the maximum and thus the shift of the web from its setpoint position.

In the simplest case, in the computer 29, the output signal of the correlator 27 is compared with an appropriate threshold and the clock signals counted until the signal maximum is reached with the value normalized to the web width. The thus normalized clock count represents the actual value of the guide criterium which is compared in a digital controller or comparator 30 with a setpoint value applied at 31 to output an error signal to an effector correcting the lateral deviation of the web. The effector can be a frame for rollers of which the web is guided.

We claim:

1. A method of controlling lateral deviations of a traveling web from a setpoint position thereof, said web having a pattern defining a guidance criterium along said web in a direction of travel thereof, said method comprising the steps of:

(a) storing a sequence of reference signals corresponding image point by image point across said web to values representing a reference scan along a line perpendicular to said direction of travel and distinguishing the guidance criterium at a location corresponding to a setpoint location of the guidance criterium of the web during the travel thereof;

(b) with an image/signal converter acquiring an image of said pattern across said web as said web is traveling past said converter, converting a single row of image points of said image across said web into a sequence of image signals each representing an average image value along an imaginary column parallel to said direction but arrayed across a width of the web, digitalizing said image values, image point by image point across said width, into a digital signal having the guidance criterium of said image distinguished by a distinct actual value representing an instantaneous location of the guidance criterium during the travel of the web, and storing the digitalized signal;

(c) shifting the digital signal formed in step (b) relative to the stored reference sequence of step (a) image point by image point in a series of shifting cycles and for each shifting cycle, calculating a similarity function whose value is a measure of a degree of correspondence of said reference sequence and the digital signal;

(d) for each image acquisition in step (b) determining the best correspondence of said reference signal and said digital signal from said similarity function, thereby deriving from the shift a correction value by which the actual position of the guidance criterium of said web deviates from the setpoint location thereof;

(e) actuating an effector to adjust the lateral position of said web in accordance with said correction value; and (f) repeating steps (b) through (e) with successive acquisitions of images from strips across said web transverse to said direction of travel at a predetermined cadence.

2. The method defined in claim 1 wherein said images are acquired in step (b) by scanning said pattern with a video camera.

3. The method defined in claim 1 wherein the image acquired in step (b) for each image acquisition extends over a full width of said web.

4. The method defined in claim 1 wherein said converter is a line camera with only a single row of sensors transverse to said direction of travel, each of said sensors generating a single image point and a monodimensional image is acquired optically across at least a portion of said web including said guidance criterium.

5. The method defined in claim 1 wherein said converter has a two-dimensional image with each column extending in said direction of travel corresponding to a single image value.

6. The method defined in claim 1 wherein, prior to influencing the lateral position in step (e) of said web, a reference image of the web is acquired and image values are generated therefrom across a width of the reference image and graphically plotted along coordinate axes corresponding to a row of image points transverse to said direction of travel, said guidance criterium being selected from a prominent pattern of the graphic plot.

7. The method defined in claim 1 wherein said similarity function is calculated by a mathematical process including difference formation.

8. The method defined in claim 1 wherein said similarity function is calculated by a mathematical process including cross correlation.

9. An apparatus for controlling lateral deviations of a traveling web from a setpoint position thereof, said web having a pattern defining a guidance criterium along said web in a direction of travel thereof, said apparatus comprising:

means for storing a sequence of reference signals corresponding image point by image point across said web to values representing a reference scan along a line perpendicular to said direction of travel and distinguishing the guidance criterium at a location corresponding to a setpoint location of the guidance criterium of the web during the travel thereof;

an image/signal converter including means for acquiring an image of said pattern across said web as said web is traveling past said converter, converting a single row of image points of said image across said web into a sequence of image signals each representing an average image value along an imaginary column parallel to said direction but arrayed across a width of the web, digitalizing said image values, image point by image point across said width, into a digital signal having the guidance criterium of said image distinguished by a distinct actual value representing an instantaneous location of the guidance criterium during the travel of the web, and storing the digitalized signal;

means for shifting the digital signal relative to the stored reference sequence image point by image point in a series of shifting cycles and for each shifting cycle, calculating a similarity function whose value is a measure of a degree of correspondence of said reference sequence and the digital signal;

means, connected with said means for shifting and in each image acquisition, for determining the best correspondence of said reference signal and said digital signal from said similarity function, thereby deriving from the shift a correction value by which the actual position of the guidance criterium of said web deviates from the setpoint location thereof; and an effector connected to said means for determining the best correspondence and adjusting the lateral position of said web in accordance with said correction value.

10. The apparatus defined in claim 9 wherein said means for shifting comprises:

a correlator having two shift registers respectively storing said digital signal of each image acquisition and said reference signal;

a clock generator connected to said shift registers for signal shifting therein;

a plurality of multipliers for forming a product of the digital and reference signals;

a summer having a number of inputs equal to the number of multipliers and connected thereto for summing the products of said multipliers; and calculating means connected to said summer for determining a maximum value of an output signal from said summer and from said maximum value and a number of clock counts of shifts corresponding thereto, the actual position of the web.

11. The apparatus defined in claim 10, further comprising a monitor graphically displaying image signals of all image points, a window generator displaying a window on a screen of said monitor for selection of said reference signal, whereby a signal displayed in said window on said screen is stored, and means for varying a size and location of said window along a row of image points.

12. The apparatus defined in claim 11 wherein said monitor has a pressure sensitive image screen and the window is adjustable on said screen by the touching of said screen.

13. A method of controlling lateral deviations of a traveling web from a setpoint position thereof, said web having a pattern defining a guidance criterium along said web in a direction of travel thereof, said method comprising the steps of:

(a) storing a sequence of reference signals corresponding image point by image point across said web to values representing a reference scan along a line perpendicular to said direction of travel and distinguishing the guidance criterium at a location corresponding to a setpoint location of the guidance criterium of the web during the travel thereof;

(b) averaging image values along a multiplicity of imaginary columns parallel to said direction but arrayed across a width of the web, digitalizing said image values image point by image point across said width in a single row, into a digital signal having the guidance criterium of said image distinguished by a distinct actual value representing an instantaneous location of the guidance criterium during the travel of the web, and storing the digitalized signal;

(c) shifting the digital signal formed in step (b) relative to the stored reference sequence of step (a) image point by image point in a series of shifting cycles and for each shifting cycle, calculating a similarity function whose value is a measure of a degree of correspondence of said reference sequence and the digital signal;

(d) for each average of image values in step (b) determining the best correspondence of said reference signal and said digital signal from said similarity function, thereby deriving from the shift a correction value by which the actual position of the guidance criterium of said web deviates from the setpoint location thereof; and (e) actuating an effector to adjust the lateral position of said web in accordance with said correction value.

* * * * *